US010154741B2

(12) United States Patent
Duck

(10) Patent No.: US 10,154,741 B2
(45) Date of Patent: Dec. 18, 2018

(54) BED-BASED PATIENT CARE APPARATUS

(71) Applicant: Medline Industries, Inc., Mundelein, IL (US)

(72) Inventor: Benjamin Duck, Johnsburg, IL (US)

(73) Assignee: Medline Industries, Inc., Northfield, IL (US)

( * ) Notice: Subject to any disclaimer, the term of this patent is extended or adjusted under 35 U.S.C. 154(b) by 416 days.

(21) Appl. No.: 14/836,582

(22) Filed: Aug. 26, 2015

(65) Prior Publication Data

US 2017/0055734 A1 Mar. 2, 2017

(51) Int. Cl.

| | |
|---|---|
| ***A47G 9/02*** | (2006.01) |
| ***A61G 1/01*** | (2006.01) |
| ***A61G 1/048*** | (2006.01) |

(52) U.S. Cl.

CPC ..... *A47G 9/0246* (2013.01); *A61G 1/01* (2013.01); *A61G 1/048* (2013.01)

(58) Field of Classification Search

CPC ..... A47G 9/02; A61G 1/01

See application file for complete search history.

(56) References Cited

U.S. PATENT DOCUMENTS

| | | | | |
|---|---|---|---|---|
| 2,598,999 A | | 6/1952 | Kelly | |
| 3,316,566 A | * | 5/1967 | Long, Sr. | A47G 9/0238 139/383 R |
| 4,074,375 A | | 2/1978 | Kella | |
| 4,338,691 A | | 7/1982 | Gaffney | |
| 4,615,061 A | * | 10/1986 | Scott | A47G 9/02 5/497 |
| 4,653,131 A | | 3/1987 | Diehl | |
| 4,793,008 A | | 12/1988 | Johansson | |
| 5,027,456 A | | 7/1991 | Wadsworth | |
| 5,070,557 A | | 12/1991 | Vincent | |
| D339,771 S | | 9/1993 | Newman | |

(Continued)

FOREIGN PATENT DOCUMENTS

| | | |
|---|---|---|
| CA | 2765604 A1 | 7/2012 |
| CA | 2779725 A1 | 12/2012 |

(Continued)

OTHER PUBLICATIONS

Han, Inho; Authorized Officer; PCT Search Report and Written Opinion for Application No. PCT/US2016/044026 dated Nov. 7, 2016; 14 pages.

(Continued)

*Primary Examiner* — Eric J Kurilla

(74) *Attorney, Agent, or Firm* — Fitch, Even, Tabin & Flannery LLP

(57) ABSTRACT

A fitted bottom sheet (which may be comprised of low-friction material if desired) can include at least one tube-receiving hole formed therethrough. By one approach the corners of the fitted bottom sheet can include a strap to help retain the fitted bottom sheet on a mattress. By one approach the aforementioned tube-receiving hole can be formed at each corner of the fitted bottom sheet. A strapless repositioning sheet can have a low-friction mattress-facing side in combination with webbing disposed along and attached to at least two side edges of the strapless repositioning sheet to thereby form a plurality of handhold openings and a plurality of strap-connection openings.

13 Claims, 5 Drawing Sheets

(56) References Cited

U.S. PATENT DOCUMENTS

| | | | | |
|---|---|---|---|---|
| 5,329,655 | A | 7/1994 | Garner | |
| 5,479,664 | A | 1/1996 | Hollander | |
| RE35,468 | E | 3/1997 | Newman | |
| 5,655,236 | A * | 8/1997 | Murray | A47G 9/0238 5/482 |
| 5,787,523 | A | 8/1998 | Lindberg | |
| 6,560,793 | B2 | 5/2003 | Walker | |
| 6,772,764 | B2 | 8/2004 | Chapman | |
| 6,859,961 | B1 | 3/2005 | Barr | |
| 6,957,455 | B1 | 10/2005 | Misson | |
| 7,017,207 | B2 * | 3/2006 | Lauderman | A47G 9/02 112/470.05 |
| D530,059 | S | 10/2006 | Tenenbaum | |
| 7,818,836 | B2 | 10/2010 | Stinson | |
| 8,161,583 | B1 | 4/2012 | Palen | |
| 8,332,976 | B1 | 12/2012 | Goldwater | |
| 8,677,530 | B2 | 3/2014 | Calkin | |
| 8,789,533 | B2 | 7/2014 | Steffens | |
| 8,850,634 | B2 | 10/2014 | Ponsi | |
| 9,314,388 | B2 | 4/2016 | Patrick | |
| 9,510,698 | B1 * | 12/2016 | Krotova | A47G 9/0246 |
| 2004/0004367 | A1 | 1/2004 | Main | |
| 2005/0034230 | A1 | 2/2005 | Weedling | |
| 2005/0132493 | A1 * | 6/2005 | Lauderman | A47G 9/02 5/495 |
| 2006/0037136 | A1 | 2/2006 | Weedling | |
| 2006/0099865 | A1 | 5/2006 | Leonard et al. | |
| 2006/0213010 | A1 | 9/2006 | Davis | |
| 2007/0266495 | A1 | 11/2007 | Stribling | |
| 2008/0209630 | A1 | 9/2008 | Kazala | |
| 2009/0004452 | A1 | 1/2009 | Assink | |
| 2009/0070933 | A1 * | 3/2009 | Hall | A47G 9/02 5/496 |
| 2009/0205134 | A1 * | 8/2009 | Wootten, Jr. | A47G 9/0246 5/488 |
| 2011/0023234 | A1 * | 2/2011 | Bolish | A47G 9/02 5/496 |
| 2011/0302717 | A1 * | 12/2011 | Campasano | A47G 9/0238 5/495 |
| 2012/0060283 | A1 * | 3/2012 | Campasano | A47G 9/0238 5/495 |
| 2012/0186013 | A1 | 7/2012 | Ponsi | |
| 2013/0205495 | A1 | 8/2013 | Ponsi | |
| 2013/0227789 | A1 | 9/2013 | Olson | |
| 2013/0270881 | A1 | 10/2013 | Fowler | |
| 2014/0013510 | A1 * | 1/2014 | Mcaleney | A47G 9/0246 5/496 |
| 2014/0304918 | A1 | 10/2014 | Steffens | |
| 2015/0047120 | A1 | 2/2015 | Partridge | |
| 2015/0143628 | A1 | 5/2015 | Fowler | |
| 2016/0089291 | A1 | 3/2016 | Tilk | |
| 2017/0055734 | A1 * | 3/2017 | Duck | A47G 9/0246 |
| 2017/0056265 | A1 * | 3/2017 | Duck | A61G 7/1026 |

FOREIGN PATENT DOCUMENTS

| | | | |
|---|---|---|---|
| EP | 2667836 | A2 | 12/2013 |
| EP | 2717825 | A2 | 4/2014 |
| EP | 2777673 | A2 | 9/2014 |
| JP | 2002320535 | | 11/2002 |
| WO | 9206624 | | 4/1992 |
| WO | 2012103232 | A2 | 8/2012 |
| WO | 2012170934 | A2 | 12/2012 |
| WO | 2013155461 | A1 | 10/2013 |

OTHER PUBLICATIONS

Han, Inho; Authorized Officer; PCT Search Report and Written Opinion for Application No. PCT/US2016/044231 dated Nov. 4, 2016; 11 pages.

Medline Industries, Inc.; product brochure for A20 Alternating Pressure, Low Air Loss, Homecare Powered Mattress; believed to have been publically available at least as early as Jan. 1, 2012; 2 pages.

Sage Products, Inc.; photographs of product Prevalon® 1.0 Turn and Position System; believed to have been publically available at least as early as Jan. 1, 2012; 3 pages.

Sage Products, Inc.; photographs of product Prevalon® 2.0 Turn and Position System; believed to have been publically available at least as early as Jan. 1, 2012; 3 pages.

Sage Products, Inc.; photographs of product Prevalon® XL Turn and Position System; believed to have been publically available at least as early as Jan. 1, 2012; 3 pages.

Sage Products, Inc.; photographs of product Prevalon® XXL Turn and Position System; believed to have been publically available at least as early as Jan. 1, 2012; 3 pages.

* cited by examiner

BED-BASED PATIENT CARE APPARATUS

TECHNICAL FIELD

These teachings relate generally to patient care bedding.

BACKGROUND

Beds of one kind or another are generally a ubiquitous feature in most patient care application settings. Accordingly, bedding is similarly commonly present in such settings. That said, bedding requirements can vary greatly with such things as the size of the patient's mattress. Mattresses, for example, can vary greatly with respect to their depth. As a result, to some large extent patient-care facilities often eschew fitted sheets because such sheets may work well with one size of mattress but not another size of mattress that can be found at the same facility.

Furthermore, the bedding needs of all patients in all application settings are not identical. Some patients, for example, may spend a significant portion of their time in an unconscious state or have other special needs. Air-powered mattresses (such as the A20 alternating pressure, low air loss homecare powered mattress as offered by Medline) are sometimes employed that permit automatic pneumatic adjustments of mattress firmness. Such mattresses typically tether to an appropriate control unit via pneumatic tubing. Typical bottom sheets, fitted or otherwise, often physically conflict with the presence of such tubing.

Some patients, whether conscious or unconscious, may be difficult to move when lying atop their bed (due, for example, to their personal weight or other special circumstances). So-called repositioning sheets (also sometimes known as glide sheets) are sometimes used to facilitate moving such a patient. Though often effective for such a purpose, existing repositioning sheets are nevertheless sometimes not completely well-suited to each and every application setting. Furthermore, such repositioning sheets are often designed without any particular consideration of the bottom sheet with which the repositioning sheet may be used.

BRIEF DESCRIPTION OF THE DRAWINGS

The above needs are at least partially met through provision of the bed-based patient care apparatus described in the following detailed description, particularly when studied in conjunction with the drawings, wherein.

Figure 1:
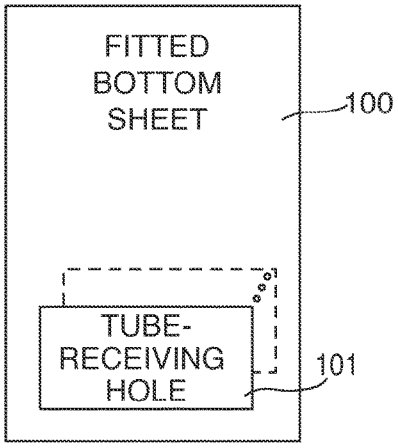
FIG. 1 comprises a block diagram as configured in accordance with various embodiments of these teachings.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, one or more components can be used individually or in combination with one another to better meet any of a variety of bedding needs and/or other needs corresponding to a bed-ridden patient.

By one approach, one such component comprises a fitted bottom sheet. This fitted bottom sheet can include straps that are disposed diagonally across the corners thereof. Such a strap can be comprised of elastic material and can be configured to be disposed beneath the mattress when the fitted bottom sheet is installed on the mattress. So configured, the fitted bottom sheet can be suitably installed on a variety of mattresses having differing depths.

By another approach, in lieu of the foregoing or in combination therewith, a fitted bottom sheet can include at least one tube-receiving hole formed therethrough. Such a tube-receiving hole can serve to receive a pneumatic tube from an air-powered mattress. So configured, the fitted sheet can be easily and quickly snugly installed on such a mattress while permitting ready and convenient access for the pneumatic tubing characteristic of such a mattress.

By yet another approach, and again in lieu of the foregoing or in combination therewith, a fitted bottom sheet can be formed using a low-friction material. Such a fitted bottom sheet can provide a low-friction surface against which a repositioning sheet can be more readily moved via sliding to thereby effect and facilitate the desired purpose and use of the repositioning sheet.

By another approach, in lieu of any of the foregoing or in combination therewith, a repositioning sheet can have a low-friction mattress-facing side in combination with webbing disposed along and attached to at least two side edges of the repositioning sheet to thereby form a plurality of handhold openings and a plurality of strap-connection openings. By one approach the handhold openings can be sized differently as compared to the strap-connection openings. By one approach the webbing is disposed on the low-friction mattress-facing side of the repositioning sheet. So configured, the low-friction mattress-facing side of the repositioning sheet can facilitate the ease with which the repositioning sheet can be moved (by sliding) to thereby move a patient lying atop the repositioning sheet. By one approach, a patient-facing side of the repositioning sheet comprises a higher-friction material than the low-friction mattress-facing side.

By one approach the repositioning sheet comprises a strapless repositioning sheet.

These teachings regarding a repositioning sheet are highly flexible in practice and will accommodate a variety of modifications and approaches. By one approach, for example, the aforementioned webbing is disposed along at least three sides of the repositioning sheet. By another approach, the webbing is disposed along all four sides of the repositioning sheet to thereby form a plurality of handhold openings and strap-connection openings on each of the four sides thereof.

As another example in these regards, the number of handhold openings and strap-connection openings can vary to suit the particular needs of a specific application setting. By one approach, the strap-connection openings can all each be located immediately proximal to a corner of the repositioning sheet. As another example in these regards, the handhold openings can be sized at least twice as long as the strap-connection openings.

The foregoing concepts and components can be used individually or in various combinations and permutations to suit a wide variety of application settings and patient needs. These teachings are readily implemented in a very economical manner. These various components are also readily employed by medical-services providers with little or no training specific to these components.

These and other benefits may become clearer upon making a thorough review and study of the following detailed description. Referring now to the drawings, this description will first address various approaches to a fitted bottom sheet. FIG. 1 presents a block diagram view of a fitted bottom sheet 100 having at least one tube-receiving hole 101 disposed therethrough.

Figure 2:
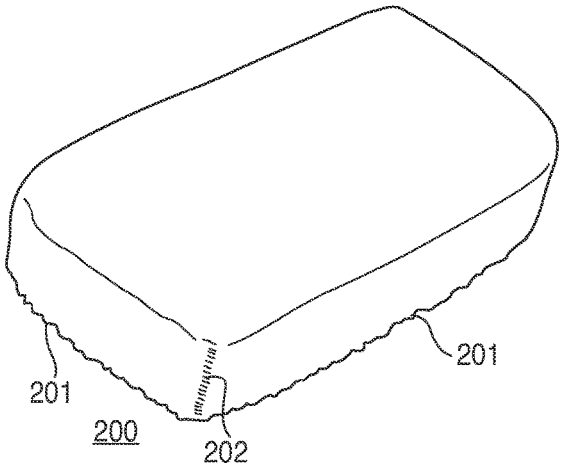
FIG. 2 PRIOR ART
FIG. 2 comprises a perspective view in accordance with the prior art.

Referring momentarily to FIG. 2, fitted bottom sheets 200 are generally well known in the art. Fitted bottom sheets 200 are sheets having elastic 201 fitted at the edges thereof. Fitted bottom sheets 200 also typically have a seam 202 formed at their corners to help facilitate placing and fitting the fitted bottom sheet 200 on a corresponding mattress. Fabrication details regarding fitted bottom sheets comprise a well understood area of prior art endeavor. Accordingly, this description will not belabor such details except where particularly appropriate to these teachings.

Referring again to FIG. 1, the fitted bottom sheet 100 can be formed using a low-friction material such as, for example, any of polyester, silk, nylon, and combinations thereof. Forming the fitted bottom sheet 100 of low-friction material can facilitate use of the fitted bottom sheet 100 with a repositioning sheet as described further herein. These teachings will also accommodate forming the fitted bottom sheet using a breathable material if desired.

In this illustrative example the fitted bottom sheet 100 has an upper surface configured to lay atop a mattress when installed on the mattress and side surfaces configured to conform to corresponding sides of the mattress when installed on the mattress. In accordance with prior art teachings, elastic fitted at the edges of the fitted bottom sheet 100 helps to maintain the fitted bottom sheet 100 in an installed position on the mattress.

Conceptually, the aforementioned tube-receiving hole 101 can be located anywhere within the perimeter of the fitted bottom sheet 100. That said, for many application settings it can be beneficial for the tube-receiving hole 101 to be located at least proximal the edges of the fitted bottom sheet 100 rather than near the center thereof. Specific details regarding possible embodiments in these regards are discussed further herein.

The aforementioned tube-receiving hole 101 can also have any of a variety of shapes, including both symmetrical shapes (such as circles, rectangles, triangles, and other regular polygons) and nonsymmetrical shapes of choice. Since many tubes have a circular cross-section, it can be beneficial in many application settings for the tube-receiving hole 101 to also have a circular shape.

By one approach the diameter of the tube-receiving hole 101 can closely match the external diameter of the intended tube to be received therethrough. In such a case, elastic can also be fitted around the perimeter of the tube-receiving hole 101 if desired. By another approach, the diameter of the tube-receiving hole 101 can be larger than the external diameter of the intended tube. For example, the tube-receiving hole 101 can be 10% larger, 25% larger, 50% larger, 100% larger, or such other size as may be appropriate.

Figure 3:
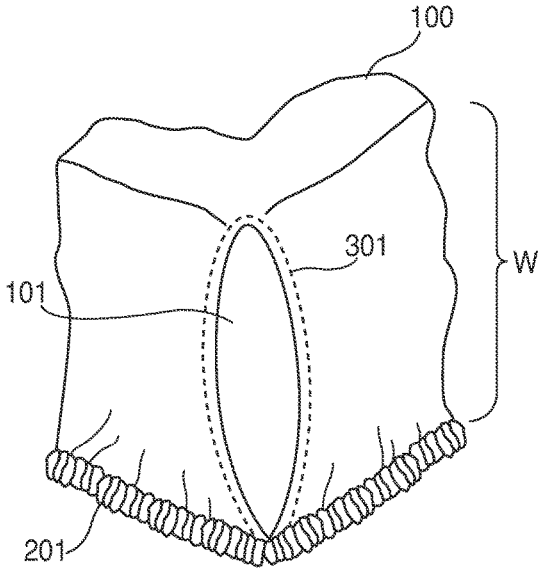
FIG. 3 comprises a detail downward perspective view as configured in accordance with various embodiments of these teachings.

By one approach, and as shown in FIG. 3, the tube-receiving hole 101 is formed at a corner of the side surfaces of the fitted bottom sheet 100. In this particular example the tube-receiving hole 101 extends for substantially the entire width W of the side surfaces of the fitted bottom sheet 100. In this example the edges that define the tube-receiving hole 101 comprise seamed edges (with the stitches that form the seamed edge being denoted by reference numeral 301).

As illustrated, the seamed edges of the tube-receiving hole 101 do not include any elastic material (unlike the edge of the fitted bottom sheet 100 itself). If desired, however, the seamed edges of the tube-receiving hole 101 can include elastic material as well.

As noted above, the fitted bottom sheet 100 can include a plurality of tube-receiving holes 101 formed therethrough if desired. As one useful example in these regards, each corner of the side surfaces of the fitted bottom sheet 100 includes a tube-receiving hole 101 as shown in FIG. 3. So configured, when the fitted bottom sheet 100 is installed on a mattress there will be one of the tube-receiving holes 101 located at each side corner of the mattress.

Figure 4:
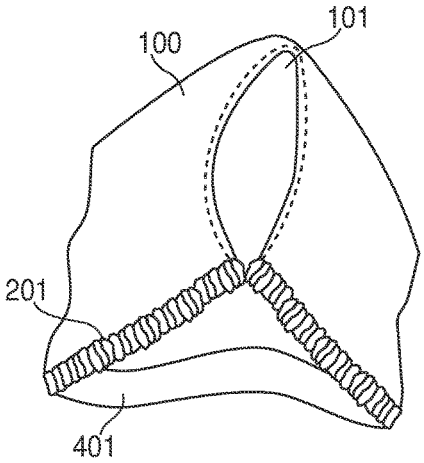
FIG. 4 comprises a detail upward perspective view as configured in accordance with various embodiments of these teachings.

By one approach, and as presented in FIG. 4, a strap 401 can be attached (for example, via corresponding stitches) to the fitted bottom sheet 100 with the strap 401 being disposed diagonally across a corresponding corner of the fitted bottom sheet 100. So disposed, the strap 401 can be readily installed beneath a mattress when the fitted bottom sheet 100 is installed on that mattress. For many application settings it will be helpful for the strap 401 to be comprised of elastic material. It will also be helpful in many application settings for the fitted bottom sheet 100 to include one of these straps 401 disposed across each corner thereof to thereby permit the fitted bottom sheet 100 to be strapped down to the mattress at each corner.

Figure 5:
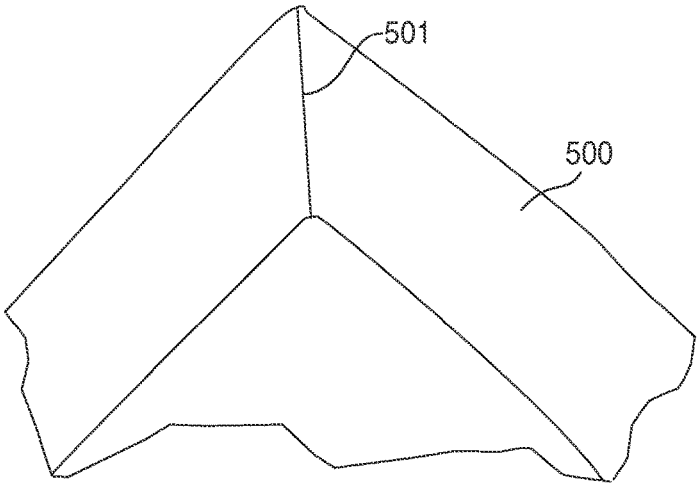
FIG. 5 PRIOR ART
FIG. 5 comprises a detail upward perspective view in accordance with the prior art.
Figure 6:
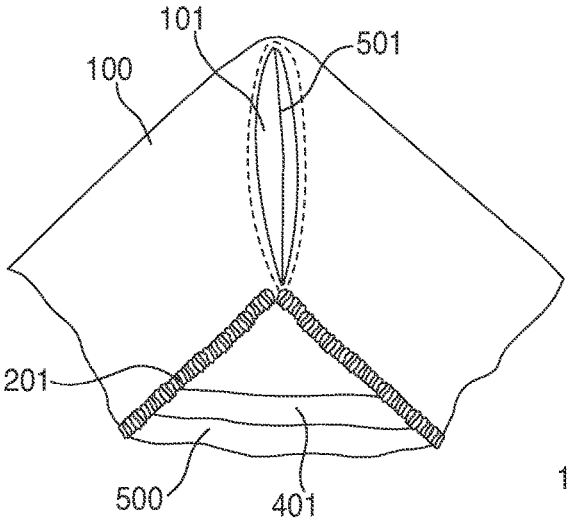
FIG. 6 comprises a detail upward perspective view as configured in accordance with various embodiments of these teachings.

FIG. 5 presents a view from the underside of a corner 501 of a mattress 500. FIG. 6, in turn, illustrates that same view of the mattress 500 when the fitted bottom sheet 100 is installed thereon. Once installed, the aforementioned elastic edges 201 and straps 401 serve to snugly retain the fitted bottom sheet 100 in place on the mattress 500.

Figure 7:
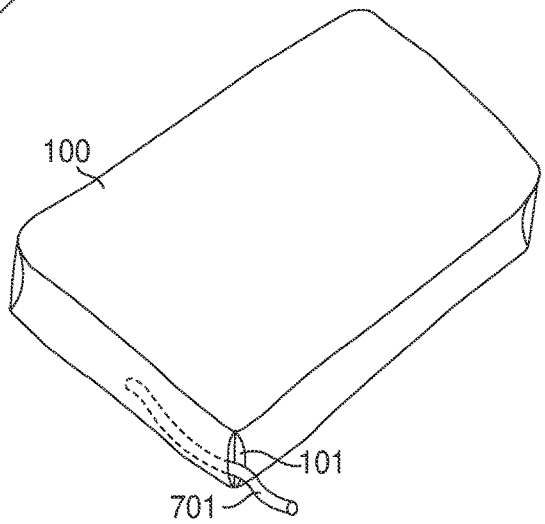
FIG. 7 comprises a perspective view as configured in accordance with various embodiments of the invention.

The tube-receiving hole 101, in turn, is located at the corner 501 of the mattress 500 and provides an opening to receive, for example, a pneumatic tube as described above. FIG. 7 presents a view where such a tube 701 is received through the aforementioned tube-receiving hole 101. So configured, the fitted bottom sheet 100 can be readily and easily installed on a mattress (such as an alternating-pressure mattress having at least one pneumatic-air to 701 extending outwardly thereof) and the elastic 201 in combination with the aforementioned straps 401 will permit the fitted bottom sheet 100 to be successfully installed on a variety of mattresses having varying depths.

Mattresses can differ in size other than with respect to depth. Accordingly, it may be useful to provide these fitted bottom sheets 100 in a variety of mattress sizes. In that case, these teachings will accommodate forming the fitted bottom sheets 100, at least in substantial part, of a variety of colors. For example, at least 10%, or 25%, or 50%, or 100% of the fitted bottom sheet 100 may be a particular corresponding color. By having the color of the fitted bottom sheet 100 correspond to a particular mattress size, persons making a patient's bed can readily locate a particular fitted bottom sheet 100 to install on a particular mattress by simply selecting a fitted bottom sheet 100 having the correct corresponding color.

Figure 8:
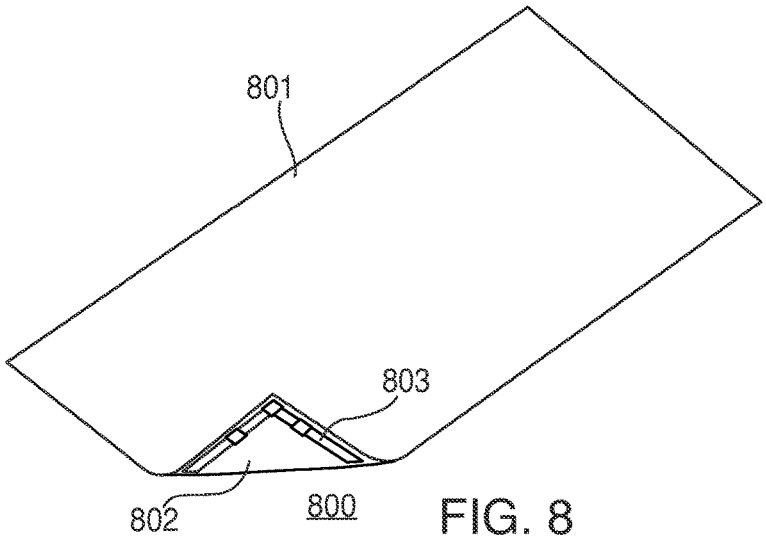
FIG. 8 comprises a perspective view as configured in accordance with various embodiments of these teachings.
Figure 9:
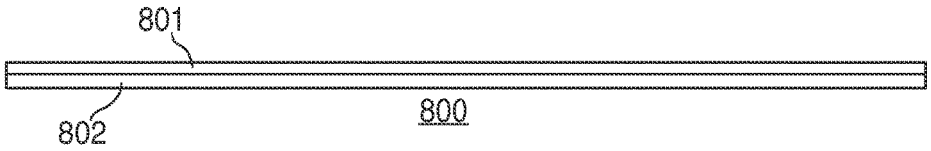
FIG. 9 comprises a side elevational view as configured in accordance with various embodiments of the invention.

In lieu of the foregoing, or in combination therewith, repositioning sheets will now be described. Generally speaking, and referring to FIGS. 8 and 9, this repositioning sheet 800 is configured for use when deployed between a mattress and a person lying atop the mattress. As will be described below, this repositioning sheet 800 can lie atop a fitted bottom sheet 100 that is installed on such a mattress, or can lie atop other bedding of choice.

For the sake of illustration, it will be presumed here that the repositioning sheet 800 comprises a strapless repositioning sheet. As used herein, this reference to being "strapless" shall be understood to mean that the repositioning sheet 800 lacks any integral sheet-securement straps of sufficient size and substance to permit securing the repositioning sheet 800 to a bed frame, mattress, or other external anchor opening. This use of "strapless" does not mean, however, that the strapless repositioning sheet 800 cannot be used with a non-integral sheet-securement strap. Indeed, as described below, the strapless repositioning sheet 800 disclosed herein is in fact configured specifically to cooperate with one or more non-integral sheet-securement straps.

In this example the strapless repositioning sheet 800 includes a patient-facing side 801 and a mattress-facing side 802. In this example these two sides are comprised of different fabrics that are stitched together. By one approach the mattress-facing side 802 comprises a low-friction mattress-facing side comprised, for example, of polyester, silk, or nylon material (alone or in combination with one another). By one approach the patient-facing side 801 of the strapless repositioning sheet 800 comprises a higher-friction material than the low-friction mattress-facing side 802. This can include materials that offer warmth and comfort to the patient.

The length and width of the strapless repositioning sheet 800 can vary with the needs of the application setting. In many cases it will suffice for the strapless repositioning sheet 800 to have a width of about 3 feet and a length of from about 4 feet to 6½ feet.

The strapless repositioning sheet 800 in this example includes webbing 803. This webbing 803 is disposed along and is attached to at least two side edges of the strapless repositioning sheet 800 to thereby form a plurality of handhold openings and a plurality of strap-connection openings (the strap-connection openings being sized and configured to loosely receive a sheet-securement strap therethrough as described below). By one approach this webbing 803 is attached on (and extends outwardly from) the low-friction mattress-facing side 802 of the strapless repositioning sheet 800 such that none of the webbing 803 is disposed on the patient-facing side 801 of the strapless repositioning sheet.

Figure 10:
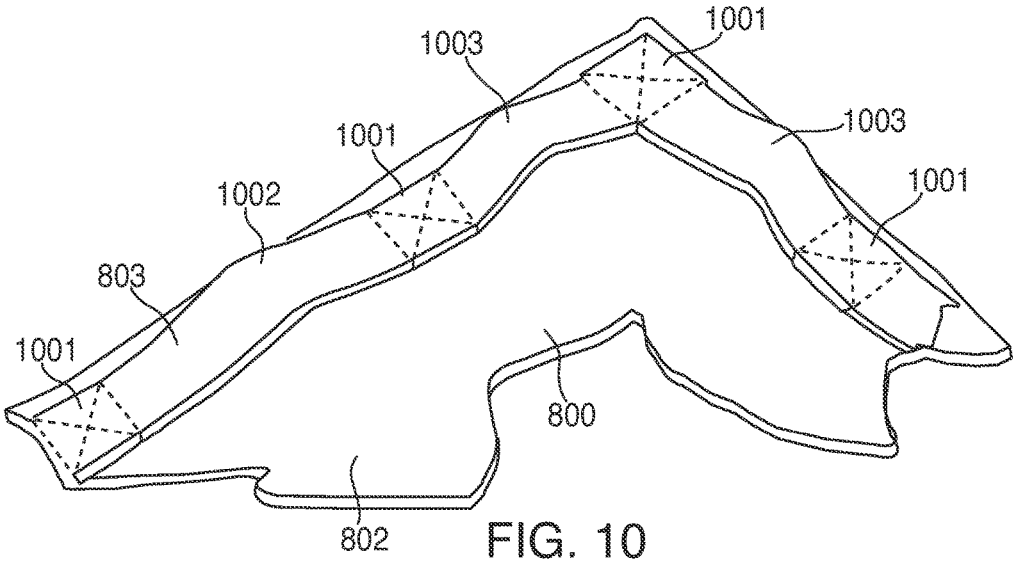
FIG. 10 comprises a detail upward perspective view as configured in accordance with various embodiments of these teachings.
Figure 11:
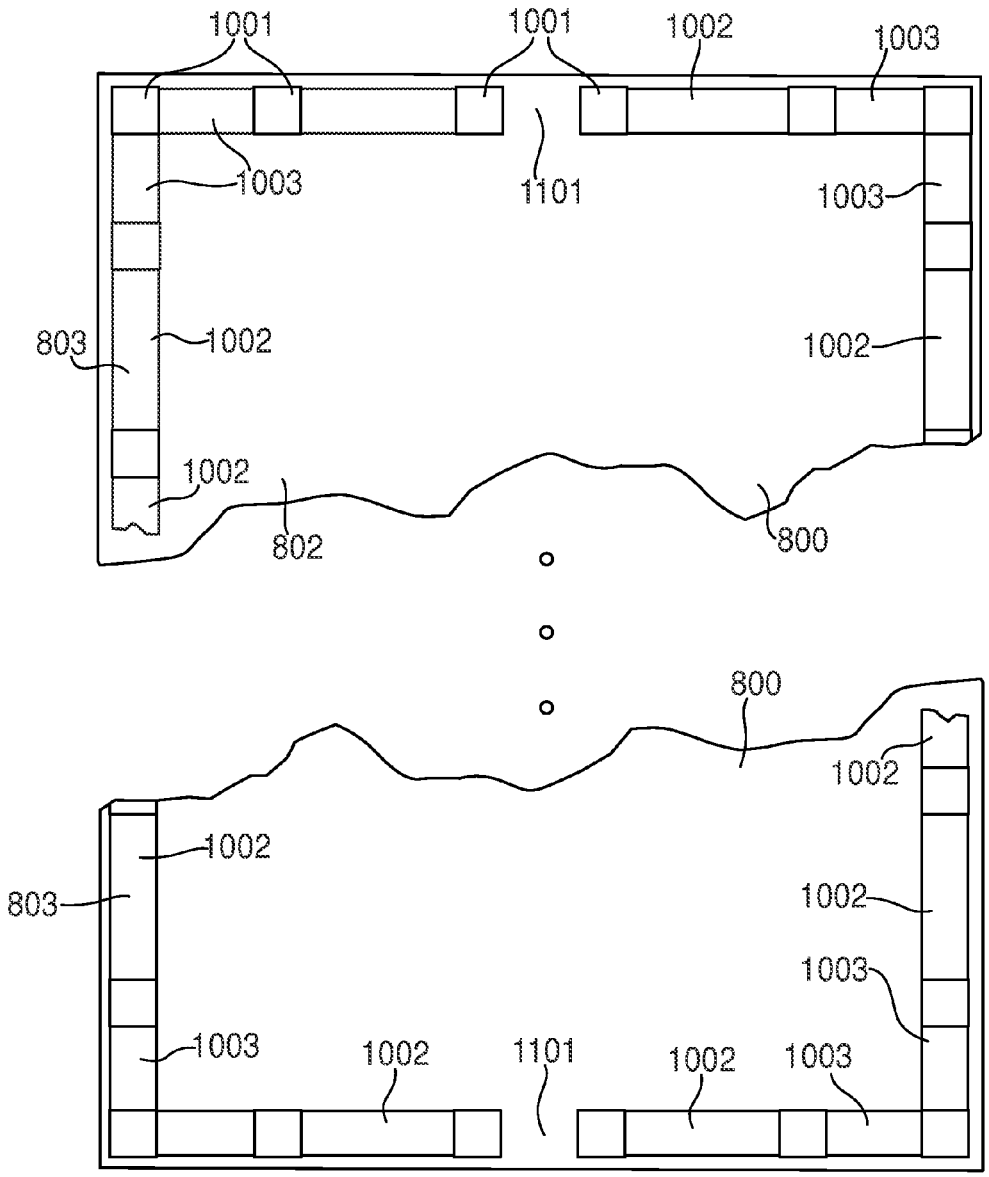
FIG. 11 comprises a bottom plan view as configured in accordance with various embodiments of these teachings.

FIGS. 10 and 11 present this webbing 803 in greater detail. The webbing 803 is attached via blocks of stitching 1001 to the low-friction mattress-facing side 802 of the strapless repositioning sheet 800 to thereby form the aforementioned plurality of handhold openings 1002 and strap-connection openings 1003. By one approach the handhold openings 1002 are sized at least twice as long as the strap-connection openings 1003. As one illustrative example, the strap-connection openings 1003 can be about two inches in length and the handhold openings 1002 can be about four and three-quarter inches in length. That said, in this example all of the handhold openings 1002 are sized substantially identically to one another and the strap-connection openings 1003 are all sized substantially identically to one another as well.

This webbing 800 can be disposed along at least two edges of the strapless repositioning sheet 800 as noted above. If desired the webbing is disposed along three sides of the strapless repositioning sheet 800 or, as shown in FIG. 11, the webbing 800 is disposed along all four sides of the strapless repositioning sheet 800 to thereby form a plurality of the handhold openings 1002 and a plurality of the strap-connection openings 1003 on each of the four sides.

In this example the strap-connection openings 1003 are all located immediately proximal to corners of the strapless repositioning sheet 800. In particular, there are no handhold openings 1002 between any of the strap-connection openings 1003 and the block stitch 1001 that anchors the webbing 800 at the corner. By one approach each side of the strapless repositioning sheet 800 has no more than two of the strap-connection openings.

Also in this example, the lateral sides of the strapless repositioning sheet 800 each have exactly two of the handhold openings 1002 and two of the strap-connection openings 1003 while the longitudinal sides of the strapless repositioning sheet 800 each have exactly two of the strap-connection openings 1003 and a significant plurality of the handhold openings 1002 (such as, for example, exactly twelve of the handhold openings 1002 along each longitudinal side). By one approach, and as illustrated in FIG. 11, the webbing 800 extends substantially fully along each of the longitudinal side edges of the strapless repositioning sheet 800 but only partially along each lateral side edge of the strapless repositioning sheet. So configured, each lateral side edge of the strapless repositioning sheet 800 has a webbing gap 1101 between the corners that border the respective lateral side edge.

Figure 12:
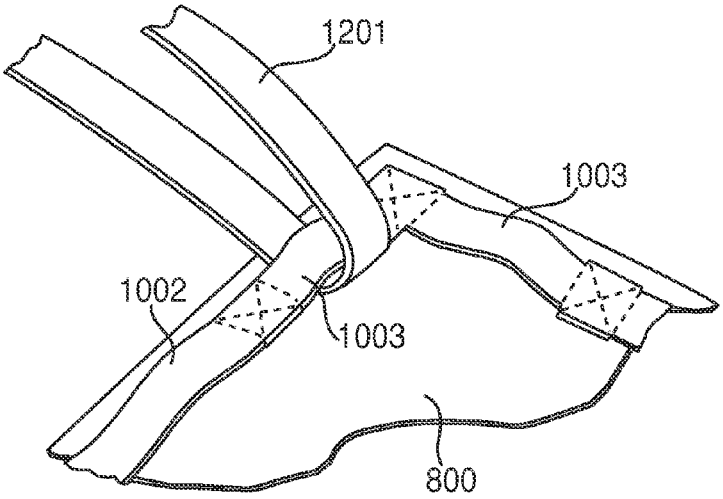
FIG. 12 comprises a detailed upward perspective view as configured in accordance with various embodiments of these teachings.

So configured the aforementioned webbing 800 lies substantially flat against the mattress-facing side 802 of the strapless repositioning sheet 800 when the latter is deployed on a mattress and the handhold openings 1002 are presently unused. FIG. 12 illustrates that a sheet-securement strap 1201 (such as a fabric or flexible plastic strap) can be passed through a given one of the strap-connection openings 1003 to thereby facilitate use of the sheet-securement strap 1201 to secure the strapless repositioning sheet 802 to an anchor point of choice (such as a side rail or head board of the bed).

Figure 13:
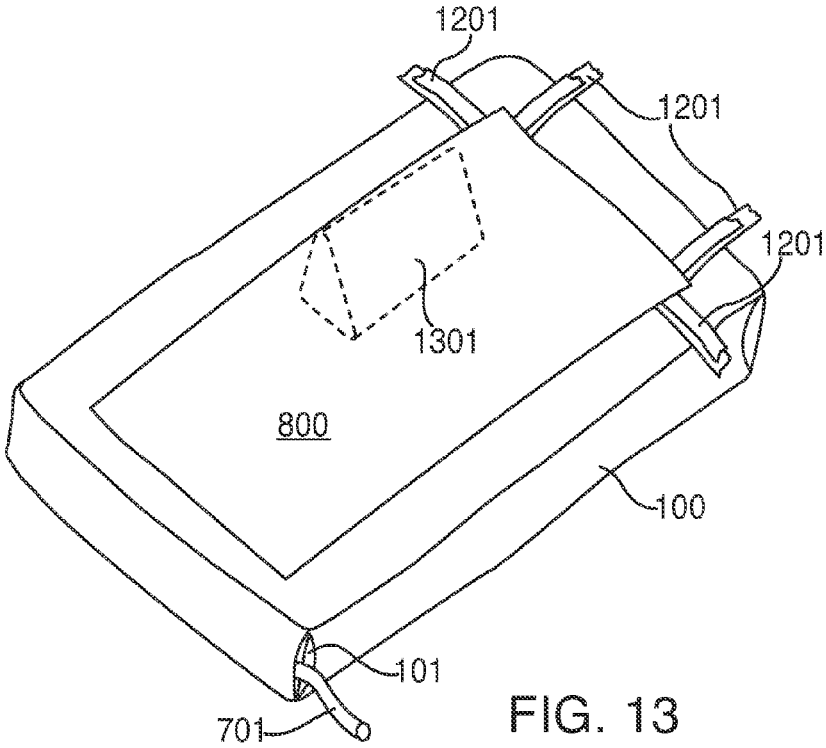
FIG. 13 comprises a perspective view as configured in accordance with various embodiments of these teachings.

FIG. 13 illustrates that such a strapless repositioning sheet 800 can be readily employed in conjunction with a fitted bottom sheet 100 as described above. The low-friction mattress-facing side 802 of the strapless repositioning sheet 800 can move very easily with respect to the low-friction material comprising the fitted bottom sheet 100 to thereby greatly ease moving a patient who is presently lying atop the strapless repositioning sheet 800 (and presuming that the aforementioned sheet-securement straps 1201 are not otherwise securing the strapless repositioning sheet 800 in place). These components can also be used in conjunction with one or more soft wedges 1301 as are known in the art to help prop and position a patient.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A fitted bottom sheet having an upper surface configured to lay atop a mattress when installed on the mattress and side surfaces configured to conform to corresponding sides of the mattress when installed on the mattress and having an edge that forms a periphery of the fitted bottom sheet, the fitted bottom sheet including at least one tube-receiving hole formed therethrough, the at least one tube-receiving hole containing a pneumatic tube from an air-powered mattress and wherein the tube-receiving hole does not extend to include the edge and wherein the tube-receiving hole itself has a fully contiguous edge.

2. The fitted bottom sheet of claim 1 wherein the fitted bottom sheet comprises, at least in part, polyester.

3. The fitted bottom sheet of claim 2 wherein the fitted bottom sheet further comprises, at least in part, at least one of silk material and nylon material.

4. The fitted bottom sheet of claim 1 wherein the at least one tube-receiving hole is formed at a corner of the side surfaces of the fitted bottom sheet.

5. The fitted bottom sheet of claim 1 wherein the fitted bottom sheet includes a plurality of the tube-receiving holes formed therethrough.

6. The fitted bottom sheet of claim 5 wherein at least some of the plurality of tube-receiving holes are formed at respective corners of the side surfaces of the fitted bottom sheet.

7. The fitted bottom sheet of claim 6 wherein each of the corners of the side surfaces of the fitted bottom sheet includes a corresponding one of the tube-receiving holes formed thereat, such that when the fitted bottom sheet is installed on the mattress there is one of the tube-receiving holes located at each side corner of the mattress.

8. The fitted bottom sheet of claim 1 further comprising a strap attached to the fitted bottom sheet and being disposed diagonally across one corner of the fitted bottom sheet and configured to be disposed beneath the mattress when the fitted bottom sheet is installed on the mattress.

9. The fitted bottom sheet of claim 8 wherein the strap is comprised of elastic material.

10. The fitted bottom sheet of claim 9 wherein each corner of the fitted bottom sheet has a strap disposed diagonally thereacross and attached to the fitted bottom sheet.

11. The fitted bottom sheet of claim 1 wherein the fitted bottom sheet comprises a color that corresponds to a mattress size as corresponds to the fitted bottom sheet.

12. The fitted bottom sheet of claim 1 wherein the mattress comprises an alternating-pressure mattress having at least one pneumatic-air tube extending outwardly thereof.

13. The fitted bottom sheet of claim 1 wherein the fitted bottom sheet is formed using a breathable material.

* * * * *